US006602811B1

(12) United States Patent
Rock et al.

(10) Patent No.: US 6,602,811 B1
(45) **Date of Patent: *Aug. 5, 2003**

(54) ANTI-MICROBIAL ENHANCED KNIT FABRIC

(75) Inventors: Moshe Rock, Andover, MA (US); Edward P. Dionne, South Paris, ME (US); Charles Haryslak, Haverhill, MA (US); William K. Lie, Methuen, MA (US); Gadalia Vainer, Melrose, MA (US)

(73) Assignee: Malden Mills Industries, Inc., Lawrence, MA (US)

( * ) Notice: Subject to any disclaimer, the term of this patent is extended or adjusted under 35 U.S.C. 154(b) by 290 days.

This patent is subject to a terminal disclaimer.

(21) Appl. No.: 09/624,824

(22) Filed: Jul. 25, 2000

(65) Prior Publication Data

(65)

Related U.S. Application Data

(63) Continuation-in-part of application No. 09/219,920, filed on Dec. 23, 1998, now Pat. No. 6,194,332.

(51) Int. Cl.[7] ..... B32B 15/00; D04B 1/16

(52) U.S. Cl. ..... 442/312; 442/316; 442/317; 442/123

(58) Field of Search ..... 442/316, 312, 442/377, 123

(56) References Cited

U.S. PATENT DOCUMENTS

| | | | | |
|---|---|---|---|---|
| 4,343,853 A | | 8/1982 | Morrison | |
| 5,047,448 A | * | 9/1991 | Tanaka et al. | 523/122 |
| 5,144,913 A | | 9/1992 | Yasui et al. | |
| 5,312,667 A | | 5/1994 | Lumb et al. | |
| 5,344,698 A | * | 9/1994 | Rock et al. | 428/253 |
| 5,405,644 A | | 4/1995 | Ohsumi et al. | |
| 5,547,733 A | | 8/1996 | Rock et al. | |
| 5,709,870 A | * | 1/1998 | Hoshimura et al. | 424/404 |
| 6,264,936 B1 | * | 7/2001 | Sawan et al. | 242/78.26 |

FOREIGN PATENT DOCUMENTS

| | | |
|---|---|---|
| EP | 1 013 809 | 6/2000 |
| FR | 2 732 224 | 10/1996 |

OTHER PUBLICATIONS

European Publication No. 1 176 241, published Jan. 30, 1902 (4 pages).

* cited by examiner

*Primary Examiner*—Terrel Morris
*Assistant Examiner*—Alexis Wachtel
(74) *Attorney, Agent, or Firm*—Fish & Richardson P.C.

(57) ABSTRACT

A composite textile fabric for removing moisture from the skin is provided. The composite fabric includes an inner, first fabric layer comprising either a polyester, polypropylene, acrylic or nylon yam material which is naturally, or has been rendered, hydrophilic and an outer, second fabric layer incorporating either a moisture-absorbent material such as cotton or a synthetic yarn which has been rendered hydrophilic, or a combination thereof. The first and second fabric layers are formed concurrently by knitting a plaited construction. The second fabric layer, but not the first layer, is blended with synthetic fibers treated to have antimicrobial properties or the second fabric layer is treated with an anti-microbial paste. An elastomeric yarn material may be added to both layers so that the composite fabric is stretchable.

34 Claims, No Drawings

ANTI-MICROBIAL ENHANCED KNIT FABRIC

This application is a continuation-in-part application of Ser. No. 09/219,920 filed Dec. 23, 1998 now U.S. Pat. No. 6,194,332.

BACKGROUND OF THE INVENTION

This invention relates to a composite textile fabric, and more particularly, to a composite fabric comprising first and second fabric layers, in which the first, or inner fabric layer, the layer closer to the skin of the wearer, is made from a synthetic yarn, and the yarn of the second, or outer fabric layer, the layer further from the skin of the wearer, is either blended with fibers treated to have anti-microbial properties or the second layer, itself, is treated with an anti-microbial paste.

Most textile fabrics are likely to result in the substantial enclosure of moisture between the wearer's skin and undergarments or between the undergarments of the wearer and the outerwear due to perspiration of the wearer. When moisture saturation takes place, the body of the wearer is wetted, causing the wearer to feel uncomfortable.

U.S. Pat. No. 5,312,667, owned by Maiden Mills Industries, Inc., describes a composite textile fabric with a first layer made of either polyester or nylon material, and a second layer having a substantial portion of a moisture absorbent material, such as cotton. U.S. Pat. No. 5,547,733, also owned by Malden Mills Industries, Inc., describes a composite textile fabric that includes an inner fabric layer made of a yarn comprising a plurality of fibers, primarily of polyester, which have been rendered hydrophilic, and an outer fabric layer made of a yarn comprising a plurality of fibers, primarily of polyester, which have also been rendered hydrophilic. For each of these patented textile fabrics, the two fabric layers are formed concurrently by knitting a plaited construction so that the layers are distinct and separate yet integrated one with the other.

While the textile fabrics described in both of these Malden Mills patents are advantageous, they are less than desirable. In each of these textile materials, liquid sweat migrates from the inner layer to the outer layer. During migration, the oily mixture of lipids and proteins which is secreted by the wearer migrates along with the liquid sweat. As a result of bacterial decomposition of these lipids and proteins, which become concentrated mainly in the outer layer of the textile fabric, an odor commonly called "body odor" is often produced.

Accordingly, it would be desirable to provide a textile fabric which facilitates liquid moisture transport to promote evaporation and keep the wearer dry, but which also substantially prevents the production of body odor.

SUMMARY OF THE INVENTION

Generally speaking, in accordance with the invention, a composite textile fabric for moving liquid moisture away from the skin and evaporating that moisture from the surface of the fabric's outer layer is provided. The composite fabric includes a first or inner fabric layer, being the layer closer to the wearer's body, made of a synthetic yarn material which is naturally or has been chemically rendered to be hydrophilic, and a second or outer fabric layer, being the layer further from the wearer's body, made of a yarn material selected from the group consisting of a moisture-absorbent yarn material such as cotton, or a synthetic yarn material, such as polyester, polypropylene, acrylic or nylon, which has been rendered hydrophilic, or a combination thereof. The inner fabric layer and outer fabric layer are formed concurrently by knitting a plaited construction so that the layers are distinct and separate, yet integrated with one another.

The Washburn equation (see E. A. Wulkow and L. C. Buckles, *Textile Research Journal*, 29:931 et seq., 1959), $$h=2y \cos \hat{e}/rpg$$

where h vertical height of wicking, y=surface tension of the liquid, ê=contact angle, r=radius of the tube, p=density of the liquid, and 9=gravitational acceleration. This "wicking" is the result of capillary action and is enhanced the finer the denier of the fiber of the outer fabric layer and the greater the difference in denier between the yarn fibers of the two layers.

In addition, the denier of the yarn (as opposed to the denier of the yarn fibers) of the inner fabric layer is no greater than the denier of the yarn of the outer fabric layer. This facilitates the horizontal spread of liquid moisture in the outer fabric layer so that moisture is more evenly distributed along this layer, as described by Hollies and his co-workers (see N. Hollies and M. Kaessinger, *Textile Research Journal*. 26: 829–835, 1956 and 27:8–13, 1957), $$S^1=y \cos \hat{e}_A r_x t/2n$$

where $S^1$=horizontal distance traveled in time t, y=surface tension of the liquid, $r_x$=effective radius, $e_A$=an apparent advance contact angle, n=viscosity of the liquid, and t=time. This, in turn, further facilitates rapid evaporation of the moisture from the outer layer. The coarser yarn of the outer fabric layer increases that layer's liquid holding capacity and therefore the "sink effect" of the outer fabric layer which, in turn, facilitates rapid transfer of the liquid moisture from the wearer's skin thorough the inner fabric layer to the outer fabric layer.

Significantly, fibers which have been treated to have anti-microbial properties are blended in the yarn of the outer layer of the inventive textile fabric construction. Accordingly, any oily mixture of lipids and proteins that is secreted by the wearer, and then migrates with the liquid sweat from the wearer's skin through the inner layer, ultimately collects in the outer layer of the fabric, does not decompose, and the production of body odor is therefore substantially prevented.

Preferably, the fibers which have been treated to have anti-microbial properties are selected from nylon or other man-made fibers coated with silver, copper or zinc metal (or ions of any thereof). These fibers are blended with the yarn material of the second or outer fabric layer in an amount between about 0.5 and 30 weight percent. The yarn blended with the treated fiber may be knit into every course of the construction for the highest degree of anti-microbial effect, every other course, every third course, and so on, to vary the level of anti-microbial effect that is desired.

Alternatively, instead of utilizing fibers which have been treated to have anti-microbial properties and blending these fibers in the yarn of the outer layer, an anti-microbial paste or coating may be applied to the outer layer of the inventive textile fabric construction. Preferably, the paste or coating includes at least one of particulate silver, copper, zinc metal or ions of any thereof.

Significantly, fibers which have been treated to have anti-microbial properties are not blended in the yarn of the inner fabric layer. Neither is the inner fabric layer coated with an anti-microbial paste or coating. This is important since there is no advantage to interfere with bacterial growth next to the skin of the wearer. Bacterial growth, per se, is not harmful.

Accordingly, it is an object of the invention to provide an improved composite textile fabric for enhancing the transport of liquid moisture away from the skin.

It is also an object of the invention to provide an improved composite textile fabric having a plurality of synthetic yarn fibers for conducting liquid moisture.

Another object of the invention is to provide an improved composite textile fabric which includes plaited layers for promoting the moisture concentration gradient therebetween.

A further object of the invention is to provide a composite textile fabric which includes an outer moisture absorbent layer and an inner layer made from a synthetic yarn which has been rendered hydrophilic.

Yet another object of the invention is to provide a composite textile fabric which includes an elastomeric yarn to render the fabric stretchable.

Still another object of the invention is to provide a composite textile fabric in which some of the fibers used to produce the fabric have anti-microbial properties.

Yet a further object of the invention is to provide a composite textile fabric which inhibits bacterial proliferation in the outer fabric layer.

Still a further object of the invention is to provide a composite textile fabric which substantially prevents the production of body odor.

Still other objects and advantages of the invention will in part be obvious and will in part be apparent from the following description.

The invention accordingly comprises fabric and fabric materials having the features, properties and relation of constituents which are exemplified in the following detailed disclosure, and the scope of the invention will be indicated in the claims.

DETAILED DESCRIPTION OF THE PREFERRED EMBODIMENT

The composite textile fabric of the invention includes a first or inner fabric layer, being the layer closer to the wearer's body, made of a synthetic yarn material and a second or outer fabric layer, being the layer further from the wearer's body, made of a yarn material selected from the group consisting of a moisture-absorbent yarn material, or a synthetic yarn which has been rendered hydrophilic, or a combination thereof. Both fabric layers are formed concurrently by knitting a plaited construction so that the layers are distinct and separate, yet integrated one with the other.

The amount of each fabric layer is selected based on the desired weight of the composite fabric, the use of the composite fabric, and the specific requirements for transferring moisture from the inner fabric layer to the outer fabric layer.

In accordance with the invention, the construction of the composite fabric is such that it is plaited. Although each fabric layer is distinct and separate, each is integrated with the other. As a result, the composite fabric functions as a single unit.

The composite fabric is either a warp or a weft knit, including circular knits such as 2-end fleece, 3-end fleece, terry with regular plaiting, double terry, double knit, plaited jersey and tricot.

Significantly, the denier of the yarn fibers (as opposed to the denier of the yarn) of the inner fabric layer is at least as great as, and preferably greater than, the denier of the yarn fibers of the outer fabric layer. This facilitates the transport of liquid moisture which collects on the inner fabric layer to the outer fabric layer. When moisture collects on the first or inner fabric layer, since the denier of the inner layer yarn fibers is at least as great as the denier of the outer layer yarn fibers, and, therefore, the inter-fiber space in the yarn of the inner fabric layer is the same as or greater than that of the outer fabric layer yarn, the quick transfer of moisture from the first layer to the second layer due to capillary action is facilitated.

Also of significance is the fact that the denier of the yarn (as opposed to the denier of the yarn fibers) of the inner fabric layer is no greater than the denier of the yarn of the outer fabric layer. This provides for a greater liquid capacity in the outer layer than in the inner layer and facilitates the horizontal spreading of moisture along the outer fabric layer—in other words, moisture collected by the inner fabric layer is transferred to the outer fabric layer and more evenly distributed on the outer fabric layer. Overall moisture is more rapidly transported from the inner fabric layer to the outer fabric layer of the composite textile fabric, since there is a lesser build-up of moisture in specific fabric locations in the outer fabric layer as a result of the facilitated spreading along the outer fabric layer. Also, because the yarn of the outer fabric layer is coarser than the yarn of the inner fabric layer, the likelihood of a "sink effect" in the outer fabric layer is increased and the likelihood of liquid moisture back-up into the inner fabric layer, where it would wet the skin of the wearer, is reduced.

More specifically, the yarn fibers of the inner fabric layer are in a range of between about 0.3 and 5.0 denier, and the yarn fibers of the outer fabric layer are within a range of between about 0.03 denier and 2.5 denier.

The denier of the yarn (itself) of the outer fabric layer is in a range of between about 70 denier and 600 denier, while the denier of the yarn of the inner fabric layer is in a range of between 30 denier and 300 denier.

The second or outer fabric layer, as stated above, may be made entirely of a synthetic yarn material, or a moisture absorbent yarn material, or it may be a blend of the two. It may also include an elastomeric yarn material plaited therein. If a moisture absorbent yarn material is included in combination with a synthetic yarn material, the moisture-absorbent yarn material is present in an amount of at least 3 percent by weight, and preferably in an amount of at least 50 percent by weight, and the synthetic yarn material will have been rendered hydrophilic. The preferred moisture-absorbent material is cotton, as it can absorb 2 to 3 times its weight in water.

Other suitable moisture-absorbent materials include rayon and wool, as well as other natural fibers.

Alternatively, the second or outer fabric layer is made entirely from a synthetic yarn material, such as nylon or polyester, which has been rendered hydrophilic.

The first or inner fabric layer comprises either polyester, polypro-pylene, acrylic or nylon material which is or has been rendered hydrophilic. It may also include an elastomeric yarn material plaited or commingled therein. The surface of the first fabric layer may be raised. This is achieved by either sanding, brushing or napping. In the preferred embodiment, the first fabric layer comprises a raised surface fabric, with each fiber end being a conductor of moisture.

The first or inner fabric layer may utilize a fiber with a modified cross-section or it may be chemically treated so that it is rendered hydrophilic, as described in U.S. Pat. No. 5,312,667, which is hereby incorporated in its entirety by reference. If the second or outer fabric layer comprises a synthetic yarn material which has been rendered hydrophilic, the denier per fiber will be smaller than the denier per fiber of the yarn in the first or inner fabric layer. This is also achieved as described in U.S. Pat. No. 5,312,667.

The yarn of the second or outer fabric layer may be spun, multi-filament, textured, end-in-end, or any combination thereof.

In the embodiment in which the second or outer fabric layer comprises a moisture-absorbent yarn material, transport of water from the surface of the first or inner fabric layer to the moisture-absorbent second or outer fabric layer is enhanced due to the first fabric layer being rendered hydrophilic. In particular, liquid moisture is made readily transportable along the surface of each polyester, acrylic or nylon fiber.

In the embodiment in which both the yarns of the first and second fabric layers are synthetic materials and are naturally, or are rendered, substantially hydrophilic, the transfer of liquid moisture from the surface of the first or inner fabric layer to the second or outer fabric layer is also enhanced. Particularly, liquid moisture is made transportable along the surface of each fiber of the first or inner fabric layer. Moisture that has been conducted to the second or outer fabric layer spreads along the surface of that layer, and is rapidly evaporated, enabling the outer fabric layer to remain substantially dry.

In accordance with the inventive composite textile fabric, fibers treated to have anti-microbial properties are blended exclusively in the yarn of the outer fabric layer. These treated fibers may be selected from nylon or other man-made fibers with silver, copper or zinc metal (or ions of any thereof) physically or chemically bonded thereon or therein. Nylon that is physically or chemically bonded with ionic silver or copper is preferred and is available in the marketplace. Also, nylon which has ionic silver or copper embedded within the fiber is also available in the marketplace. Whether the nylon or other synthetic yarn is either coated with ionic silver or copper, or has one of these substances embedded therein, the amount of this special fiber that is blended into the yarn of the second layer is between about 0.5% and 50% by weight.

Testing of composite textile fabrics in which the second or outer fabric layer has incorporated therein nylon or another synthetic yarn coated or imbedded with ionic silver or copper demonstrates that bacterial proliferation in the second layer is substantially inhibited. As a result, any oily mixture of lipids and proteins that has been secreted and which has migrated with liquid sweat from the wearer's skin through the inner layer, ultimately collecting in the outer layer of the fabric, does not decompose, and the production of body odor is substantially prevented.

Thus, the inventive fabric, because there is nothing interposed between the first and second fabric layers, rapidly moves moisture away from the skin and through a garment made with the composite fabric, enhanced by the creation of a moisture concentration gradient. In addition, because the second fabric layer incorporates fibers with anti-microbial properties, bacterial growth in that layer is substantially inhibited, and therefore, body odor is materially prevented.

In an alternative embodiment, a paste or coating having anti-microbial properties is applied exclusively to the outer layer of the inventive fabric. The paste or coating preferably includes at least one of particulate silver, copper, zinc, or ions of any thereof. These particles are incorporated into the coating or paste in an amount between about 0.01 and 50 percent by volume. Such pastes or coatings are readily available in the marketplace. The amount of the coating or paste which is applied to the outer layer of the fabric is between about 0.01 and 75 percent o.w.f.

The main component of the paste or coating, into which the particles are incorporated, may be polyurethane, acrylic or silicone polymers. The paste or coating may be hydrophilic such as by selecting polymers that are hydrophilic or may be rendered hydrophilic by subsequent treatment. In order to improve fabric breath ability, the paste or coating, may be aerated (into a foam or froth) prior to application; it may also be applied to the outer fabric layer in a pattern or design having uncoated areas. In general, application of the paste or coating to the outer layer of the fabric is carried out with a roller, plain or rotogravure, a knife or by any other conventional coating technique. Application may also be carried out by screen printing.

It will thus be seen that the objects set forth above, among those made apparent from the preceding description, are efficiently attained, and since certain changes may be made in the textile fabric described herein without departing from the spirit and scope of the invention, it is intended that all matter contained in the above description shall be interpreted as illustrative and not in a limiting sense.

It is also to be understood that the following claims are intended to cover all of the generic and specific features of the invention described herein, and all statements of the scope of the invention which, as a matter of language, might be said to fall therebetween.

We claim:

1. A composite textile fabric comprising a first fabric layer of a synthetic yarn which is or has been rendered hydrophilic and a second fabric layer of a yarn material selected from the group consisting of a moisture-absorbent yarn, or a synthetic yarn rendered hydrophilic, or a combination thereof;

wherein only the second fabric layer is treated by at least one of (a) blending the yarn of said second layer with fibers having anti-microbial properties; and (b) applying a paste or coating having anti-microbial properties to said second layer;

wherein the first and second fabric layers are formed concurrently by knitting a plaited construction.

2. The fabric of claim 1, wherein the yarn of said second fabric layer is blended with fibers having anti-microbial properties in an amount between about 0.5 and 50 weight percent.

3. The fabric of claim 1, wherein the fibers having anti-microbial properties comprise fibers treated with at least one of silver, copper, zinc or ions of any thereof.

4. The fabric of claim 3, wherein said at least one of silver, copper, zinc or ions of any thereof is chemically or physically bonded on the fibers.

5. The fabric of claim 3, wherein at least one of silver, copper, zinc or ions of any thereof is embedded in the fibers.

6. The fabric of claim 1, wherein the fibers are nylon or other man-made fibers treated with at least one of silver, copper, zinc or ions of any thereof.

7. The fabric of claim 1, wherein said paste or coating is applied to said second layer of the fabric in an amount between about 0.01 and 75 percent o.w.f.

8. The fabric of claim 1, wherein said paste or coating includes particles selected from the group consisting of particulate silver, particulate copper, particulate zinc, or ions of any thereof.

9. The fabric of claim 1, wherein said paste includes a vehicle as a main component selected from polyurethane, acrylic and silicone polymers.

10. The fabric of claim 8, wherein said particles are included in said paste or coating in an amount between about 0.01 and 50 percent by volume.

11. The fabric of claim 1, wherein said paste or coating is hydrophilic.

12. The fabric of claim 1, wherein said paste or coating is rendered hydrophilic following application to said second layer.

13. The fabric of claim 1, wherein said paste or coating is an aerated material selected from the group consisting of a foam and a froth.

14. The fabric of claim 1, wherein said paste or coating is discontinuously applied to said second layer.

15. The fabric of claim 1, wherein said first fabric layer has a raised surface.

16. The fabric of claim 1, wherein said first fabric layer has a flat surface.

17. The fabric of claim 1, wherein the fabric has a circular knit construction selected from the group consisting of 2-end fleece, 3-end fleece, terry with regular plaiting, double terry, double needle raschel, double knit, plaited jersey and tricot.

18. The fabric of claim 1, wherein the denier of the yarn of the first fabric layer is no greater than the denier of the yarn of the second fabric layer.

19. The fabric of claim 18, wherein the yarn of the second fabric layer has a denier of between about 70 and 600 and the yarn of the first fabric layer has a denier of between about 30 and 300.

20. The fabric of claim 1, wherein the first fabric layer comprises yarn fibers having a denier of at least that of the yarns fibers of the second fabric layer.

21. The fabric of claim 20, wherein the yarn fibers of the first fabric layer have a denier between 0.3 and 5.0 and the yarn fibers of the second fabric layer have a denier between 0.03 and 2.5.

22. The fabric of claim 1, wherein said moisture-absorbent yarn is selected from the group consisting of cotton, rayon and wool.

23. The fabric of claim 1, wherein said synthetic yarn material of said first fabric layer is selected from the group consisting of polypropylene, polyester, acrylic and nylon.

24. The fabric of claim 1, wherein each of said layers has an elastomeric yarn plaited therein.

25. The fabric of claim 1, wherein said second fabric layer comprises at least 3% by weight of said moisture-absorbent yarn.

26. A composite textile fabric comprising a first fabric layer of a synthetic yarn selected from the group consisting of polyester, acrylic and nylon, said synthetic yarn of said first fabric layer being naturally, or having been rendered, hydrophilic, and a second fabric layer having one of the following materials:

a. a moisture-absorbent yarn material selected from the group consisting of cotton, rayon and wool; or b. a synthetic yarn which has been rendered hydrophilic and selected from the group consisting of polyester, polypropylene, acrylic and nylon; or c. a combination of a moisture-absorbent yarn material selected from the group consisting of cotton, rayon and wool, and a synthetic yarn material which has been rendered hydrophilic and selected from the group consisting of polyester, polypropylene, acrylic and nylon.

wherein only said second fabric layer is treated by one of (a) blending said second layer yarn with synthetic yarn fibers treated with at least one of silver, copper, or zinc metal or ions of any thereof in an amount between about 0.5 and 50 weight percent; (b) applying a paste or coating which includes particles suspended therein and selected from the group consisting of silver, copper, or zinc metal, or ions of any thereof in an amount between about 0.01 and 75 percent o.w.f.;

wherein the first and second layers are formed concurrently by knitting a plaited construction.

27. The fabric of claim 26, wherein said blended synthetic yarn fibers are coated with ionic silver or copper.

28. The fabric of claim 26, wherein said blended synthetic yarn fibers have ionic silver or copper embedded therein.

29. The fabric of claim 26, wherein each of said layers has an elastomeric yarn plaited therein.

30. The fabric of claim 26, wherein said particles are suspended in said paste or coating.

31. The fabric of claim 26, wherein said paste comprises a vehicle as a main component selected from polyurethane, acrylic and silicone polymers.

32. The fabric of claim 26, wherein said particles are included in said paste or coating in an amount between about 0.01 and 50.0 percent by volume.

33. The fabric of claim 26, wherein said paste or coating is an aerated material selected from a foam or froth.

34. The fabric of claim 26, wherein said paste or coating is discontinuously applied to said second layer.

* * * * *